US008691742B2

(12) United States Patent
Boutique et al.

(10) Patent No.: US 8,691,742 B2
(45) **Date of Patent: *Apr. 8, 2014**

(54) LIQUID DETERGENT COMPOSITIONS EXHIBITING TWO OR MULTICOLOR EFFECT

(75) Inventors: Jean-Pol Boutique, Gembloux (BE); Karl Ghislain Braeckman, Gerpinnes (BE); Karel Jozef Maria Depoot, Anzegem-Vichte (BE); Jan-Sebastiaan Uyttersprot, Halle (BE); Tim Roger Michel Vanpachtenbeke, Puurs (BE); Nathalie Jean Marie-Louise Vanwyngaerden, Leuven (BE)

(73) Assignee: The Procter & Gamble Company, Cincinnati, OH (US)

( * ) Notice: Subject to any disclaimer, the term of this patent is extended or adjusted under 35 U.S.C. 154(b) by 133 days.

This patent is subject to a terminal disclaimer.

(21) Appl. No.: 12/568,176

(22) Filed: Sep. 28, 2009

(65) Prior Publication Data

US 2010/0081600 A1 Apr. 1, 2010

(30) Foreign Application Priority Data

Sep. 30, 2008 (EP) ..... 08165489

(51) Int. Cl.

| | |
|---|---|
| ***C11D 3/14*** | (2006.01) |
| ***C11D 3/386*** | (2006.01) |
| ***C11D 3/40*** | (2006.01) |
| ***C11D 17/04*** | (2006.01) |

(52) U.S. Cl.

USPC ..... 510/337; 510/108; 510/221; 510/235; 510/238; 510/295; 510/343; 510/393; 510/405; 510/406; 510/419

(58) Field of Classification Search

USPC ..... 510/405, 406, 108, 221, 238, 295, 337, 510/343, 419, 235, 393

See application file for complete search history.

(56) References Cited

U.S. PATENT DOCUMENTS

| | | | | |
|---|---|---|---|---|
| 5,089,148 | A | 2/1992 | Van Blarcom et al. | |
| 5,716,920 | A * | 2/1998 | Glenn et al. | 510/159 |
| 6,664,225 | B2 * | 12/2003 | Mumoli | 510/446 |
| 7,485,183 | B2 * | 2/2009 | Hochstein et al. | 106/499 |
| 2004/0234561 | A1 * | 11/2004 | Ansmann et al. | 424/401 |
| 2005/0100570 | A1 * | 5/2005 | Wei et al. | 424/401 |
| 2005/0112160 | A1 * | 5/2005 | Tanner et al. | 424/401 |
| 2005/0192187 | A1 * | 9/2005 | Wagner et al. | 510/130 |
| 2005/0192189 | A1 * | 9/2005 | Wagner et al. | 510/130 |
| 2005/0276768 | A1 * | 12/2005 | Wei et al. | 424/63 |
| 2006/0094628 | A1 * | 5/2006 | Wei et al. | 510/417 |
| 2006/0280706 | A1 * | 12/2006 | Sebillotte-Arnaud | 424/63 |
| 2007/0059269 | A1 * | 3/2007 | Bernard et al. | 424/70.22 |
| 2007/0065381 | A1 * | 3/2007 | Elsbrock et al. | 424/63 |
| 2007/0141001 | A1 * | 6/2007 | Clapp et al. | 424/63 |
| 2008/0015135 | A1 * | 1/2008 | de Buzzaccarini et al. | 510/336 |
| 2008/0032909 | A1 * | 2/2008 | de Buzzaccarini et al. | 510/293 |
| 2008/0044372 | A1 * | 2/2008 | Vatter | 424/78.02 |
| 2008/0044494 | A1 * | 2/2008 | Robinson et al. | 424/684 |
| 2008/0234169 | A1 * | 9/2008 | Boutique et al. | 510/343 |
| 2008/0261844 | A1 * | 10/2008 | Ruppert et al. | 510/158 |
| 2009/0196836 | A1 * | 8/2009 | Tanner et al. | 424/59 |
| 2010/0081601 | A1 | 4/2010 | Boutique et al. | |

FOREIGN PATENT DOCUMENTS

| | | | |
|---|---|---|---|
| WO | WO 2004/003125 | A1 | 1/2004 |
| WO | WO 2006/027001 | A1 * | 3/2006 |
| WO | WO 2007/031970 | A2 * | 3/2007 |
| WO | WO 2007/111887 | A2 | 10/2007 |
| WO | WO 2007/111888 | A1 | 10/2007 |
| WO | WO 2007/111892 | A2 * | 10/2007 |
| WO | WO 2007/111892 | A2 | 10/2007 |
| WO | WO 2007/111898 | A2 * | 10/2007 |

OTHER PUBLICATIONS

International Search Report dated Jan. 14, 2010, 3 pages. (PCT/US2009/057677).

* cited by examiner

*Primary Examiner* — Lorna M Douyon

(74) *Attorney, Agent, or Firm* — Melissa G. Krasovec; Steven W. Miller

(57) ABSTRACT

Treatment composition, preferably liquid detergent compositions exhibiting a two, or multicolor effect, comprising an aesthetic system including a colored interference pigment and a dye system.

18 Claims, 1 Drawing Sheet

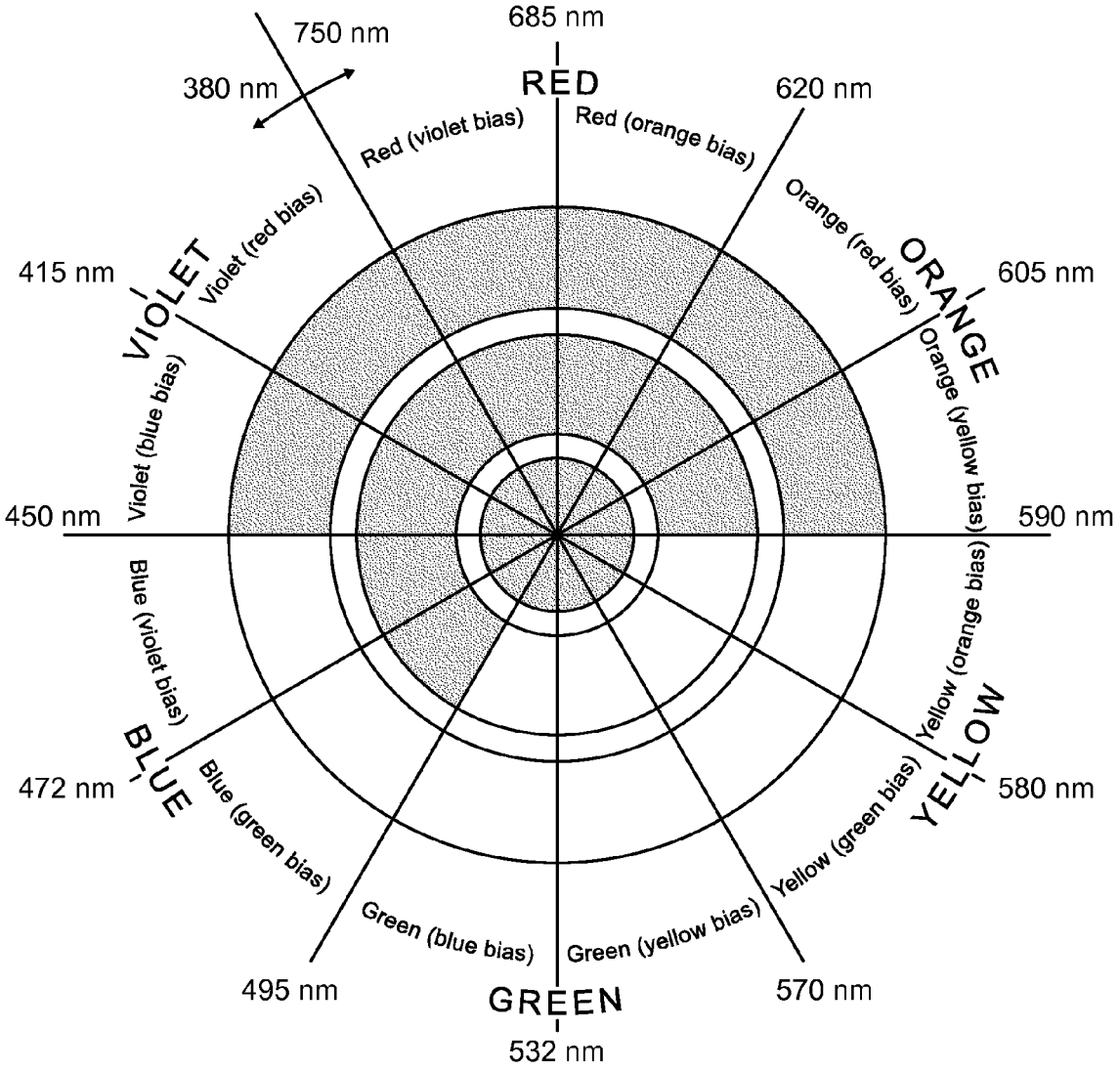
750 nm
685 nm
380 nm
RED
620 nm
Red (violet bias)
Red (orange bias)
Orange (red bias)
Violet (red bias)
415 nm
VIOLET
ORANGE
605 nm
Violet (blue bias)
Orange (yellow bias)
450 nm
590 nm
Blue (violet bias)
Yellow (orange bias)
BLUE
YELLOW
472 nm
580 nm
Blue (green bias)
Yellow (green bias)
Green (blue bias)
Green (yellow bias)
495 nm
570 nm
GREEN
532 nm

LIQUID DETERGENT COMPOSITIONS EXHIBITING TWO OR MULTICOLOR EFFECT

TECHNICAL FIELD

The present invention relates to the field of a treatment composition, preferably liquid detergent compositions exhibiting a two, or multicolor effect, comprising an aesthetic system including a colored interference pigment and a dye system.

BACKGROUND OF THE INVENTION

Nowadays, consumers are very attracted by products having nice aspect and attractive appearance, thus efforts are been made in view of improving the aesthetics of a composition. In the preparation of liquid treatment compositions, it is always an aim to convey the composition's technical capabilities through the aesthetics of the composition. The present invention specifically relates to the aim of improving on the aesthetics of liquid detergent compositions.

Detergent compositions having improved aesthetics appearance have been already disclosed in the following art: WO 2007/111887 (P&G—publication date: 4 Oct. 2007) relates to laundry detergent composition comprising a hueing dye and a pearlescent agent. WO 2007/111892 (P&G—publication date: 26 Sep. 2006) relates to a liquid detergent composition comprising a fabric care benefit agent and a pearlescent agent. U.S. Pat. No. 5,089,148 (Unilever—publication date: 18 Feb. 1992) describes liquid fabric conditioning compositions comprising softening component and a colorant system comprising a yellow colorant. WO 04/003125 (Reckitt Benckiser—publication date: 8 Jan. 2004) describes a gel detergent composition having a first color and primary particles having a second color, wherein the radiation emitted by the gel interacts with the radiation emitted by the primary particles such that at least a portion of the composition has a third color.

However, a problem associated with the use of aesthetic agents, and especially pigments, in liquid cleaning applications is the likely deposition of the agent on the surface being treated. On fabrics, especially dark fabrics, such deposits or residues can be visible with the naked eye. Moreover they may tend to draw the eye as, by their nature, they tend to sparkle in light. Furthermore, such deposits are unappealing as they give the consumers the perception of the surface being dirty.

Therefore, in spite of the advances in the art, there remains a challenge to formulate compositions containing aesthetic agents which both stably suspend said agents and avoid the appearance of deposits or residues on the surface being treated.

The present invention relates to liquid detergent compositions comprising ingredients that are capable of generating various color as well as nice optical effects. This improved aesthetic system is achieved by incorporation and suspension of a colored interference pigment in the liquid composition.

The main advantage of the invention is, thus, to formulate liquid or gel detergents exhibiting a two- or multi-tone optical/color effect, providing aesthetics which are attractive to consumers.

Another advantage of the present invention is, to provide a composition containing a low level of colored interference pigment, which markedly improves aesthetics whilst not leading to unacceptable residues on washed surfaces.

Thus, due to the low level an ingredient, the present invention has the benefit of improving the fabrics safety of the fabric treated with the composition according to the present invention.

SUMMARY OF THE INVENTION

According to the present invention, there is provided a liquid detergent composition exhibiting at least two color effect, comprising:

1) a cleaning system, comprising a surfactant and laundry adjunct;
2) an aesthetic system comprising:
   i. a colored interference pigment showing an absorbance minimum in the 380-750 nm range of light spectrum,
   ii. and a dye system, wherein the color of the colored interference pigment is selected so as to be complementary to the color reflected by the composition comprising the dye in absence of the colored interference pigment.

BRIEF DESCRIPTION OF THE DRAWING

FIG. 1 is a color's diagram which illustrates the definition of complementary colors.

DETAILED DESCRIPTION OF THE INVENTION

Detergent Composition

The liquid compositions of the present invention are suitable for use as laundry or other surface cleaning treatment compositions, such as hard surface cleaning treatment compositions. Preferably, the liquid compositions of the present invention are suitable for use as laundry treatment compositions.

By the term laundry treatment composition it is meant to include all liquid compositions used in the treatment of laundry including cleaning and softening or conditioning compositions. By the term hard surface treatment compositions it is meant to include all liquid compositions used in the treatment of hard surfaces, such as kitchen or bathroom surfaces, as well as dish and cook ware in the hand or automatic dishwashing operations.

In a preferred embodiment, the composition of the present invention is a detergent liquid composition, more preferably a liquid laundry detergent composition.

The compositions herein described are formulated as liquids compositions, including gel and paste form. The composition is preferably a structured composition. By structured composition, it is meant herein that the composition is internally structured by a surfactant, or externally structured by a thickener or structurant. Typically, the composition is a fluid having the physical form of a flowable liquid, gel or paste.

The compositions are, preferably, but not necessarily, formulated as aqueous compositions. Where the compositions are aqueous they may comprise from 2% to 90% of water, more preferably from 20% to 80% of water and most preferably from 25% to 65% of water. Non-aqueous compositions comprise less than 20% water, preferably less than 12%, most preferably less than 9.5% water.

When the composition is packaged in water-soluble film, such as polyvinyl alcohol film and its derivatives, it is preferred that the composition comprise from 2% to 15% water, more preferably from 2% to 10% of water and most preferably from 4% to 9% water.

The compositions of the present invention can be thin liquids, pourable thickened liquids or stiff gels that can be squeezed out of a bottle and may exhibit Newtonian or non-Newtonian rheology behavior.

Preferably, the compositions of the present invention have viscosity from 1 to 10000 mPa*s, more preferably from 100 to 7000 mPa*s, and most preferably from 200 to 5000 mPa*s at 20 $s^{-1}$ and measured at 21° C.

Viscosity can be determined by conventional methods. Viscosity according to the present invention however is measured using an AR 550 rheometer from TA instruments using a plate steel spindle at 40 mm diameter and a gap size of 500 μm. The high shear viscosity at 20 $s^{-1}$ and low shear viscosity at 0.05 $s^{-1}$ can be obtained from a logarithmic shear rate sweep from 0.1 $s^{-1}$ to 25 $s^{-1}$ in 3 minutes time at 21 C. The preferred rheology described therein may be achieved using internal existing structuring with detergent ingredients or by employing an external rheology modifier.

Preferably, according to the present invention, the liquid detergent composition has a low shear viscosity at 0.05 $s^{-1}$ at 21° C., greater than 2 000 mPa*s, more preferably greater than 5 000 mPas*s, even more preferably greater than 10 000 mPa*s, to maintain the colored interference pigment stably suspended.

Preferably, according to the present invention, the liquid detergent composition comprises a rheology modifier as a laundry adjunct, which is not part of the surfactant system, and which imparts shear thinning characteristics to the composition such that the composition has a low shear viscosity at 0.05 $s^{-1}$ at 21° C. of greater than 5 000 mPa*s. The rheology modifier is a structurant or a thickener, as distinct from viscosity reducing agents.

Preferably, the compositions according to the present invention exhibit a yield value in the range of from 0.1 Pa to 5 Pa, more preferably from 0.3 to 1.2 Pa.

The compositions (before adding the colored interference pigment) preferably have an absolute turbidity of 5 to 3 000 NTU as measured with a turbidity meter of the nephelometric type. Turbidity according to the present invention is measured using an Analyte NEP160 with probe NEP260 from McVan Instruments, Australia.

Preferably, the compositions are optically clear, i.e. transparent or translucent prior to adding the colored interference pigment.

The compositions of the present invention preferably have a pH of from 3 to 10, more preferably from 5 to 9, even more preferably from 6 to 9, most preferably from 7.1 to 8.5 when measured by dissolving the liquid to at 1% by weight in demineralised water. In a more preferred embodiment, the pH of the compositions is greater than 7, preferably greater than 7.5.

The Aesthetic System

The composition, according to the present invention, contains an aesthetic system, which help the composition to exhibit at least two color effects, preferably a multicolor effect. The aesthetic system comprises a colored interference pigment as first essential element and a dye system as second essential element. More specifically, the aesthetic system is made of the combination of a colored interference pigment with a dye system that exhibits the complementary color of the colored interference pigment.

Thus, according to the present invention, it is important that the color of the colored interference pigment is selected so as to be complementary to the color reflected by the composition comprising the dye in the absence of the colored interference pigment.

As complementary color, it is meant herein color which lie on the opposite side of any given color of a color's diagram such as illustrated in FIG. 1. For example, in FIG. 1, the red color is complementary colors to the green color. The differences between the two colors are very noticeable and each one will appear to be emphasized.

Indeed, these complementary colors increase the contrast existing between the colored interference pigment and the background color of the liquid detergent. The difference between the two colors will then be very noticeable and each one will thus appear to be emphasized. This combination generates nice and improved optical effects, toward the consumers, whilst allowing the use low level of the colored interference pigment in the detergent formula.

The color perceived herein are perceived under normal conditions, e.g. CIE Standard Illuminant A or D65 which represents average daylight.

Colored Interference Pigment

As "colored interference pigments", it is meant herein a pigment that exhibit iridescence, an optical phenomenon in which hue changes according to the angle from which the surface is viewed. Colored interference pigments, according to the present invention, provide excellent iridescent aesthetics in liquid detergent compositions and unambiguous evidence of interference effects, unlike common insoluble minerals like clays.

As an essential characteristic, colored interference pigments show an absorbance minimum in the 380-750 nm (visible) range of the light spectrum. In contrast, pearlescent pigments have a flat wavelength response in the visible light spectrum. As a result, colored interference pigments reemit light at specific wavelengths in the visible spectrum, whilst pearlescent pigments reemit "silvery-white" light without specific color.

Thus, according to the present invention, the colored interference pigment, present in the composition, shows one or more absorbance minima in the 380-750 nm (visible) range of the light spectrum.

The colored interference pigments can be chosen, but no limited to, from the group of interference pigments consisting of: colored interference pigments showing an absorption minimum in the 570-590 nm range (violet color); colored interference pigments showing at least an absorption minimum in the 590-620 nm range (blue color); colored interference pigments showing at least an absorption minimum in the 620-750 nm range (green color); colored interference pigments showing at least an absorption minimum in the 380-450 nm range (yellow color); colored interference pigments showing at least an absorption minimum in the 450-495 nm range (orange color); colored interference pigments showing at least an absorption minimum in the 495-570 nm range (red color) or mixture thereof.

The colored interference pigments of the present invention are crystalline or glassy solids, transparent or translucent compounds capable of reflecting and refracting light to produce the desired iridescent effect. The colored interference pigments of the present invention are insoluble in aqueous and in non-aqueous detergent compositions.

For the purposes of the present invention, colored interference pigments are defined as particles having two or more layers of controlled thickness with different refractive indices. The colored interference pigments yield a characteristic reflected color from the interference of typically two, but occasionally more, light reflections, from different layers of the particle, which may be thin and plate-like. Non-limiting examples of suitable colored interference pigments for the compositions of the present invention comprise a base substrate particle comprised of natural or synthetic mica, borosilicate glass, silica, bismuth oxychloride, glitter (polyester or metallic) and mixtures thereof, layered with films of titanium dioxide, silica, tin oxide, iron oxide, rutile, chromium dioxide, aluminum oxide, zirconium oxide, bismuth oxychloride, and mixtures thereof, wherein the thickness of the layers is from 60 nm to about 300 nm. More preferably, the colored interference pigments are mica coated with titanium dioxide.

The layers can contain a dye. In that specific a embodiment case, the dye is not releasable into the detergent composition.

The thickness of the layer coating the substrate is larger than 60 nm in the colored interference pigments according to the invention. Colored interference pigments are different from commonly known pearlescent pigments which exhibit only a "silvery-white" visual effect as this "silvery-white" visual effect is due to the small thickness (less than 60 nm) of the $TiO_2$ layer of pearlescent pigments.

Without wishing to be bound by theory, the Applicant believes that the characteristic of single reflection color of each pigment is an optical effect caused by light interference. Therefore, through controlled thickness of the metal oxide layer, all colors of the rainbow can be achieved.

Moreover, by using different particle size, with mica as a base, colored interference pigments can exhibit different luster effects (silky, pearl, sparkling, glittering).

Preferably, the coated mica colored interference pigments will have: a $TiO_2$ layer having a thickness comprised between 60 and 80 nm in view of exhibiting a gold color; a $TiO_2$ layer having a thickness comprised between 80 and 100 nm in view of exhibiting a red color; a $TiO_2$ layer having a thickness comprised between 100 and 140 nm in view of exhibiting a blue color and a $TiO_2$ layer having a thickness comprised between 120 and 160 nm in view of exhibiting a green color.

Commercially available colored interference pigments suitable are available from BASF under the trade-names Lumina Gold, Lumina Turquoise, Lumina Green, Lumina Red, Lumina Red Blue, Lumina Aqua Blue, Rutile Fine Lilas, Mearlin Dynacolor Green Blue, Mearlin Dynacolor Blue Green, Mearlin Dynacolor Green, Exterior Red, exterior Blue, exterior Gold.

Other commercially available colored interference pigments are available from Merck under the trade-names of Timiron Super Blue, Timiron Gold Plus, Iriodin Rutile Fine Red, Iriodin Rutile Fine Lilac, Iriodin Rutile Fine Green, Iriodin Rutile Fine Blue, iriodin Rutile Fine Gold., and Iriodin Rutile Red Pearl.

Particle size is measured across the largest diameter of the sphere. Plate-like particles are such that two dimensions of the particle (length and width) are at least 5 times the third dimension (depth or thickness). Other crystal shapes like cubes or needles or other crystal shapes do not display pearlescent effect. Many colored interference pigments like mica are natural minerals having monoclinic crystals. Shape appears to affect the stability of the agents. The spherical, even more preferably, the plate-like agents being the most successfully stabilized.

In a preferred embodiment, the colored interference pigments have D0.99 (sometimes referred to as D99) volume particle size of less than 50 μm. Most preferably the colored interference pigments have particle size distribution of from 0.1 μm to 50 μm, more preferably from 0.5 μm to 25 μm and most preferably from 1 μm to 20 μm. The D0.99 is a measure of particle size relating to particle size distribution and meaning in this instance that 99% of the particles have volume particle size of less than 50 μm.

Volume particle size and particle size distribution are measured using the Hydro 2000G equipment available from Malvern Instruments Ltd. Particle size has a role in stabilization of the pigments. The smaller the particle size and distribution are, the more easily they are suspended. However as you decrease the particle size of the colored interference pigments, so you decrease the efficacy of the pigments.

In a specific embodiment, the liquid compositions of the present invention comprise less than 0.1%, by weight of the total composition, of a colored interference pigment. Preferably the liquid compositions of the present invention comprise from 0.0001% to 0.5%, preferably from 0.001% up to 0.1%, most preferably from 0.01% up to 0.05% by weight of the total composition, of a colored interference pigment.

In preferred embodiments of the invention, the colored interference pigment is uniformly dispersed throughout the composition, and the composition includes surfactants and/or rheology modifiers in amounts sufficient to stably suspend the colored interference pigment.

Dye System

The aesthetic system comprises, as a second essential element, a dye system. More specifically, the dye system is specifically chosen in view of exhibiting the complementary color of the colored interference pigment.

Preferably, the dye system is composed of one or several non-fluorescent dyes. The dye system comprises one or more water and/or oil and/or surfactant soluble dyes. Various shades can be obtained by mixing two dyes, especially two blue dyes, or a blue dye and a violet dye. The dye system may comprise only non-staining dyes, or may comprise a mixture of a hueing dye with a non-hueing/non-staining dye. The dyes used in the dye system of the present invention can be hypochlorite bleachable. In a preferred embodiment, the dye system is free of phthalocyanine dyes.

Dyes suitable for use herein are disclosed in Kirk Othmer Encyclopaedia of Chemical technology, Fifth Edition, Volume 9, Wiley, 2005 at pages 238-430. Dyes include azo dyes, anthraquinone dyes, benzofuranone dyes, polycyclic aromatic carbonyl dyes containing one or more carbonyl groups linked by a quinoid system, indigoid dyes, polymethine and related dyes, styryl dyes, di- and tri-aryl carbonium and related dyes, such as diphenylmethane, methylene blue, oxazine and xanthene types; also useful are the phthalocyanines for instance those including di- and trusulfonated types; quinophthalones, sulphur dyes and nitro-dyes.

Highly preferred dyes include dyes having low fastness to textiles, sometime termed non-staining dyes. These have high aesthetic effect but do not discolor laundered textiles. Such dyes often comprise solubility enhancing moieties such as PEG moieties and have been described in various patent applications. See for example U.S. Pat. No. 6,417,155 and WO 2007/087252.

Another class of preferred dyes includes dyes having a bluing effect on textiles. These dyes are more generally termed "hueing" or "fabric hueing" dyes in the laundry detergent art.

Dyes useful herein can further include those described in WO 2006/045375 a1, WO 2006/017570 A1, WO 2007/006357 A1, WO 2006/032327 A1, WO 2007/096068 A1, WO 2007/096066 A1, WO 2008/065028 A1, WO 2008/064978 A1 and WO 2008/064977 A1 (Unilever). Other low-staining dyes are disclosed in U.S. Pat. Nos. 4,144,024, 4,110,238, 3,958,928, and 4,077,911. Suitable mixtures of blue dyes, that can be used in the dye system further, include the dyes of U.S. Pat. No. 3,755,201. Suitable thiazolium dyes are described in WO 2007/084729 (P&G). Other hueing dyes, in US 2006-0183658 (P&G) and US 2005-0288206 have specific hueing effectiveness. Suitable Triphenylmethane blue and violet base dyes are described in US 2005-0288207 (P&G) and U.S. Pat. No. 4,526,701.

In contrast to the colored interference pigments mentioned before, the dyes exhibit solubility in water and/or in oil and/or in organic solvents and/or in liquid detergents. The structure of dyes fundamentally permits solubility. For avoidance of doubt, the dyes herein do not exhibit interference effects, and dyes suitable for use herein can have a wide range of solubility ranging from very sparingly soluble (e.g. disperse dyes) to highly water soluble.

In alternate terms, dyes can be defined functionally as being acid, basic, reactive, disperse, direct, vat, sulphur or solvent dyes, etc. For the purposes of the present invention, direct dyes, acid dyes and reactive dyes are preferred, direct dyes are most preferred. Direct dye is a group of water-soluble dye taken up directly by fibers from an aqueous solution containing an electrolyte, presumably due to selective adsorption. In the Color Index system, directive dye refers to various planar, highly conjugated molecular structures that contain one or more anionic sulfonate group. Acid dye is a group of water soluble anionic dyes that is applied from an acidic solution. Reactive dye is a group of dyes containing reactive groups capable of forming covalent linkages with certain portions of the molecules of natural or synthetic fibers. From the chemical structure point of view, suitable fabric substantive dyes useful herein may be an azo compound, stilbenes, oxazines and phthalocyanines. Suitable fabric substantive dyes for use herein include those listed in the Color Index as Direct Violet dyes, Direct Blue dyes, Acid Violet dyes and Acid Blue dyes. In a specific embodiment, the liquid compositions of the present invention comprise from 0.0001% to 0.1%, preferably from 0.0002% to 0.01%, and more preferably from 0.0005% to 0.005% by weight of the total composition, of a dye system.

In a preferred embodiment of the present invention, the weight percentage of the colored interference pigment exceeds the weight percentage of the dye system present in the composition.

The composition, according to the present invention, contains an aesthetic system which helps the composition to exhibiting at least two color effects, i.e. two or a multicolor effect. Thus, according to the present invention, it is important that the color of the colored interference pigment is selected so as to be complementary to the color reflected by the composition comprising the dye in absence of the colored interference pigment.

This combination generates nice and improved optical effects, toward the consumers, mainly by increasing the contrast existing between the colored interference pigment and the background color of the liquid detergent. This combination allows thus the use of a low level of dye in the detergent formula.

Thus, according to one aspect to the present invention, the composition can be a yellow liquid detergent containing a violet colored interference pigment. This combination of complementary color is the result of a liquid detergent which comprises a dye system showing an absorption maximum in the 620-750 nm or 380-495 nm range, preferably in the 685-750 nm or 380-472 nm range, more preferably in the 380-450 nm range and containing also colored interference pigments showing an absorption minimum in the 570-590 nm range.

According to another aspect to the present invention, the composition can be an orange liquid detergent containing a blue colored interference pigment. This combination of complementary color is the result of a liquid detergent which comprises a dye system showing an absorption maximum in the 380-570 nm range, preferably in the 415-532 nm range, more preferably in the 450-495 nm range and containing also colored interference pigments showing an absorption minimum in the 590-620 nm range.

Also, according to another aspect to the present invention, the composition can be a red liquid detergent containing a green colored interference pigment. This combination of complementary color is the result of a liquid detergent which comprises a dye system showing an absorption maximum in the 450-590 nm range, preferably in the 472-580, more preferably in the 495-570 nm range and containing also colored interference pigments showing an absorption minimum in the 620-750 nm range.

In addition, according to a further aspect, the composition can be a violet liquid detergent containing a yellow colored interference pigment. This combination of complementary color is the result of a liquid detergent which comprises a dye system showing an absorption maximum in the 495-620 nm range, preferably in the 532-605 nm range, more preferably in the 570-590 nm range and containing also colored interference pigments showing an absorption minimum in the 380-450 nm range.

According to another further aspect, the composition can be a blue liquid detergent containing an orange colored interference pigment. This combination of complementary color is the result of a liquid detergent which comprises a dye system showing an absorption maximum in the 570-750 nm range, preferably in the 580-685 nm range, more preferably in the 590-620 nm range and containing also colored interference pigments showing an absorption minimum in the 450-495 nm range.

According to a further aspect, the composition can be a green liquid detergent containing a red colored interference pigment. This combination of complementary color is the result of a liquid detergent which comprises a dye system showing an absorption maximum in the 590-750 nm or 380-450 nm range, preferably in the 605-750 nm or 380-415 nm range, more preferably in the 620-750 nm range and containing also colored interference pigments showing an absorption minimum in the 495-570 nm range.

The aesthetic system of the present invention, i.e. colored interference pigments and dyes, e.g. in the form of a mixture, can in general exhibit more than one absorption band in the visible spectrum. In such situation, the effect of the composition of the present invention can equally be reached by use of the center of gravity of the energy distribution of the absorbed wavelength. See for example the Kirk-Othmer Encyclopedia of chemical technology, vol. 7, pages 303-341 (2004), J. Wily & Sens.

Cleaning System

The composition, according to the present invention, contains a cleaning system. The cleaning system comprises a surfactant. The cleaning system requires sufficient surfactant to launder textiles, i.e. it differs from compositions such as cosmetics where surfactants are occasionally used as emulsifiers at low levels.

The compositions of the present invention typically comprise from about 5% to about 80% by weight of a surfactant. Preferably such compositions comprise from about 7% to about 50% by weight of surfactant. More preferably, such compositions comprise from about 10% to about 40% by weight of a surfactant.

A preferred surfactant system comprises a mixture of anionic and nonionic surfactants, where the weight ratio of anionic to nonionic is preferably greater than 1.

Surfactants

Detersive surfactants utilized can be of the anionic, nonionic, zwitterionic, ampholytic or cationic type or can comprise compatible mixtures of these types. More preferably surfactants are selected from the group consisting of anionic, nonionic, cationic surfactants and mixtures thereof. Preferably the compositions are substantially free of betaine surfactants.

Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups). Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulphonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulphonates in which the average number of carbon atoms in the alkyl group is from about 11 to 13, abbreviated as $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Laundry Adjunct

Preferably, the composition, according to the present invention, further contains one or several laundry adjunct.

As laundry adjunct is it meant herein all ingredient typically in laundry detergent composition such as rheology modifier; fabric care benefit agents; detersive enzymes; deposition aid; builder; bleach system.

The liquid compositions of the present invention may thus comprise other ingredients selected from the list of optional ingredients set out below. Unless specified herein below, an "effective amount" of a particular laundry adjunct is preferably from 0.01%, more preferably from 0.1%, even more preferably from 1% to 20%, more preferably to 15%, even more preferably to 10%, still even more preferably to 7%, most preferably to 5% by weight of the detergent compositions.

Preferably, the composition of the present invention comprises laundry adjunct selected from the group consisting of rheology modifier, fluorescent whitening agent, builders, dyes transfer inhibitors, fabric care benefit agents, detersive enzymes, chelants, deposition aids, polyacrylate polymers, dispersing agents, perfumes, bleach additives, bleach activators, bleach catalysts, solvents, enzyme inhibitors, soil release polymers and mixtures thereof. More preferably, the composition of the present invention comprises laundry adjunct selected from the group consisting of rheology modifier, fluorescent whitening agent, fabric care benefit agents, detersive enzymes, deposition aids or mixture thereof.

Even more preferably, the composition of the present invention comprises as laundry adjunct a rheology modifier.

Rheology Modifier

In a preferred embodiment of the present invention, the composition comprises a rheology modifier as a highly preferred laundry adjunct. The rheology modifier is a structurant or a thickener, as distinct from viscosity reducing agents. The rheology modifier is selected from the group consisting of non-polymeric crystalline, hydroxy-functional materials, polymeric rheology modifiers which impart shear thinning characteristics to the aqueous liquid matrix of the composition. Such rheology modifiers are preferably those which impart to the aqueous liquid composition a high shear viscosity at 20 $s^{-1}$ at 21° C. of from 1 to 10 000 mPa*s cps and a viscosity at low shear (0.05 $s^{-1}$ at 21° C.) of greater than 2 000 mPa*s. Viscosity according to the present invention is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1 $s^{-1}$ to 25 $s^{-1}$ in 3 minutes time at 21 C. Crystalline, hydroxy-functional materials are rheology modifiers which form thread-like structuring systems throughout the matrix of the composition upon in situ crystallization in the matrix. Polymeric rheology modifiers are preferably selected from polyacrylates, polymeric gums, other non-gum polysaccharides, and combinations of these polymeric materials. The overall objective in adding such a rheology modifier to the compositions herein is to arrive at liquid compositions which are suitably functional and aesthetically pleasing from the standpoint of product thickness, product pourability, product optical properties, and/or particles suspension performance. Thus the rheology modifier will generally serve to establish appropriate rheological characteristics of the liquid product and will do so without imparting any undesirable attributes to the product such as unacceptable optical properties or unwanted phase separation. Generally the rheology modifier will comprise from 0.01% to 1% by weight, preferably from 0.05% to 0.75% by weight, more preferably from 0.1% to 0.5% by weight, of the compositions herein.

The rheology modifier component of the compositions herein can be characterized as an "external" or "internal" rheology modifier. Preferably the rheology modifier of the present invention is an external rheology modifier. An "external" rheology modifier, for purposes of this invention, is a material which has as its primary function that of providing rheological alteration of the liquid matrix. Generally, therefore, an external rheology modifier will not, in and of itself, provide any significant fabric cleaning or fabric care benefit or any significant ingredient solubilization benefit. An external rheology modifier is thus distinct from an "internal" rheology modifier which may also alter matrix rheology but which has been incorporated into the liquid product for some additional primary purpose. Thus, for example, a preferred internal rheology modifier would be anionic surfactants which can serve to alter rheological properties of liquid detergents, but which have been added to the product primarily to act as the cleaning ingredient.

The external rheology modifier of the compositions of the present invention is used to provide an aqueous liquid matrix for the composition which has certain rheological characteristics. The principal one of these characteristics is that the matrix must be "shear-thinning". A shear-thinning fluid is one with a viscosity which decreases as shear is applied to the fluid. Thus, at rest, i.e., during storage or shipping of the liquid detergent product, the liquid matrix of the composition should have a relatively high viscosity. When shear is applied to the composition, however, such as in the act of pouring or squeezing the composition from its container, the viscosity of the matrix should be lowered to the extent that dispensing of the fluid product is easily and readily accomplished.

The at-rest viscosity of the compositions herein will ideally be high enough to accomplish several purposes. Chief among these purposes is that the composition at rest should be sufficiently viscous to suitably suspend the colored interference pigment, another essential component of the invention herein. A secondary benefit of a relatively high at-rest viscosity is an aesthetic one of giving the composition the appearance of a thick, strong, effective product as opposed to a thin, weak, watery one.

Finally, the requisite rheological characteristics of the liquid matrix should be provided via an external rheology modifier which does not disadvantageously detract from the visibility of the aesthetic agent suspended within the composition, i.e., by making the matrix opaque to the extent that the suspended obscured aesthetic agent is obscured.

Materials which form shear-thinning fluids when combined with water or other aqueous liquids are generally known in the art. Such materials can be selected for use in the compositions herein provided they can be used to form an aqueous liquid matrix having the rheological characteristics set forth hereinbefore.

One type of structuring agent which is especially useful in the compositions of the present invention comprises non-polymeric (except for conventional alkoxylation), crystalline hydroxy-functional materials which can form thread-like structuring systems throughout the liquid matrix when they are crystallized within the matrix in situ. Such materials can be generally characterized as crystalline, hydroxyl-containing fatty acids, fatty esters or fatty waxes. Such materials will generally be selected from those having the following formulas:

I) 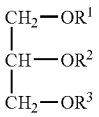

wherein:

$R^1$ is 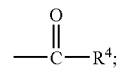 ;

R2 is R1 or H; R3 is R1 or H; R4 is independently C10-C22 alkyl or alkenyl comprising at least one hydroxyl group;

II) 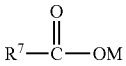

wherein:

$R^7$ is 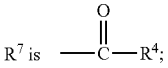 ;

$R^4$ is as defined above in i); M is $Na^+$, $K^+$, $Me^{++}$ or $Al^{3+}$, or H; and $$Z—(CH(OH))a\text{-}Z' \qquad \text{III}$$

where a is from 2 to 4, preferably 2; Z and Z' are hydrophobic groups, especially selected from $C_6$-$C_{20}$ alkyl or cycloalkyl, $C_6$-$C_{24}$ alkaryl or aralkyl, $C_6$-$C_{20}$ aryl or mixtures thereof. Optionally Z can contain one or more non-polar oxygen atoms as in ethers or esters.

Materials of the Formula I type are preferred. They can be more particularly defined by the following formula:

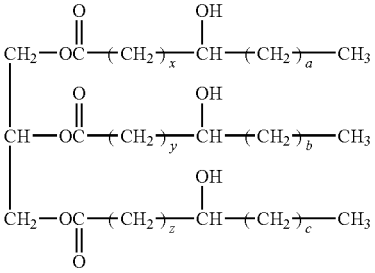

wherein:

(x+a) is from between 11 and 17;

(y+b) is from between 11 and 17; and (z+c) is from between 11 and 17.

Preferably, in this formula x=y=z=10 and/or a=b=c=5.

Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis).

Alternative commercially available materials that are suitable for use as crystalline, hydroxyl-containing rheology modifiers are those of Formula III hereinbefore. An example of a rheology modifier of this type is 1,4-di-O-benzyl-D-Threitol in the R,R, and S,S forms and any mixtures, optically active or not.

All of these crystalline, hydroxyl-containing rheology modifiers as hereinbefore described are believed to function by forming thread-like structuring systems when they are crystallized in situ within the aqueous liquid matrix of the compositions herein or within a pre-mix which is used to form such an aqueous liquid matrix. Such crystallization is brought about by heating an aqueous mixture of these materials to a temperature above the melting point of the rheology modifier, followed by cooling of the mixture to room temperature while maintaining the liquid under agitation.

Under certain conditions, the crystalline, hydroxyl-containing rheology modifiers will, upon cooling, form the thread-like structuring system within the aqueous liquid matrix. This thread-like system can comprise a fibrous or entangled thread-like network. Non-fibrous particles in the form of "rosettas" may also be formed. The particles in this network can have an aspect ratio of from 1.5:1 to 200:1, more preferably from 10:1 to 200:1. Such fibers and non-fibrous particles can have a minor dimension which ranges from 1 micron to 100 microns, more preferably from 5 microns to 15 microns.

These crystalline, hydroxyl-containing materials are especially preferred rheology modifiers for providing the detergent compositions herein with shear-thinning rheology. They can effectively be used for this purpose at concentrations which are low enough that the compositions are not rendered so undesirably opaque that bead visibility is restricted. These materials and the networks they form also serve to stabilize the compositions herein against liquid-liquid or solid-liquid (except, of course, for the beads and the structuring system particles) phase separation. Their use thus permits the formulator to use less of relatively expensive non-aqueous solvents or phase stabilizers which might otherwise have to be used in higher concentrations to minimize undesirable phase separation. These preferred crystalline, hydroxyl-containing rheology modifiers are described in detail in U.S. Pat. No. 6,080,708 and in WO 02/40627.

Other types of rheology modifiers, besides the non-polymeric, crystalline, hydroxyl-containing rheology modifiers described hereinbefore, may be utilized in the liquid detergent compositions herein. Polymeric materials which will provide shear-thinning characteristics to the aqueous liquid matrix may also be employed.

Suitable polymeric rheology modifiers include those of the polyacrylate, polysaccharide or polysaccharide derivative type. Polysaccharide derivatives typically used as rheology modifiers comprise polymeric gum materials. Such gums include pectine, alginate, arabinogalactan (gum Arabic), carrageenan, gellan gum, xanthan gum and guar gum.

If polymeric rheology modifiers are employed herein, a preferred material of this type is gellan gum. Gellan gum is a heteropolysaccharide prepared by fermentation of Pseudomonaselodea ATCC 31461. Gellan gum is commercially marketed by CP Kelco U.S., Inc. under the KELCO-GEL trade-name. Processes for preparing gellan gum are described in U.S. Pat. Nos. 4,326,052; 4,326,053; 4,377,636 and 4,385,123.

A further alternative and suitable rheology modifier is a combination of a solvent and a polycarboxylate polymer. More specifically the solvent is preferably an alkylene glycol. More preferably the solvent is dipropy-glycol. Preferably the polycarboxylate polymer is a polyacrylate, poly-methacrylate or mixtures thereof. The solvent is preferably present at a level of from 0.5 to 15%, preferably from 2 to 9% of the composition. The polycarboxylate polymer is preferably present at a level of from 0.1 to 10%, more preferably 2 to 5% of the composition. The solvent component preferably comprises a mixture of dipropykeneglycol and 1,2-propanediol. The ratio of dipropyleneglycol to 1,2-propanediol is preferably 3:1 to 1:3, more preferably 1:1. The polyacrylate is preferably a copolymer of unsaturated mono- or di-carbonic acid and 1-30C alkyl ester of the (meth) acrylic acid. In another preferred embodiment the rheology modifier is a polyacrylate of unsaturated mono- or di-carbonic acid and 1-30C alkyl ester of the (meth) acrylic acid. Such copolymers are available from Noveon Inc under the trade-name Carbopol Aqua 30.

Of course, any other rheology modifiers besides the foregoing specifically described materials can be employed in the aqueous liquid detergent compositions herein, provided such other rheology modifier materials produce compositions having the selected rheological characteristics hereinbefore described. Also combinations of various rheology modifiers and rheology modifier types may be utilized, again so long as the resulting aqueous matrix of the composition possesses the hereinbefore specified pour viscosity, constant stress viscosity and viscosity ratio values.

Optical Brightener

Composition of the present invention may also comprise one or more optical brighteners, also known as fluorescent whitening agents (FWAs) as a laundry adjunct. These optical brighteners absorb light in the ultraviolet region of the spectrum and re-emit it in the visible blue range. The optical brighteners are deposited onto fabrics or laundered garments, such as cotton garments, whereupon they fluoresce. This helps to compensate for loss of whiteness and/or yellowing which occurs on white fabrics as they age or as they are repeatedly washed. As fluorescent dyes, the optical brighteners herein lie outside the definition of the essential and non-fluorescent dyes defined hereinbefore.

Preferred optical brighteners are anionic in character. Suitable optical brighteners include specific stilbene derivatives, more particularly diaminostilbenedisulphonic acids and their salts. The salts of 4,4'-bis(2-anilino-4-morpholino-1,3,5-triazinyl-6-amino) stilbene-2, 2'-disulphonic acid, and related compounds where the morpholino group is replaced by another nitrogen-comprising moiety, are preferred; as are brighteners of the 4,4'-bis(2-sulphostyryl) biphenyl type. Mixtures of brighteners can be used. Further examples of optical brighteners include disodium 4,4'-bis-(2-diethanolamino-4-anilino-s-triazin-6-ylamino)stilbene-2:2' disulphonate, disodium 4,4'-bis-(2-morpholino-4-anilino-s-triazin-6-ylamino)stilbene-2:2' disulphonate, disodium 4,4'-bis-(2,4-dianilino-s-triazin-6-ylamino)stilbene-2:2'-disulphonate, monosodium 4',4"-bis-(2,4-dianilino-s-triazin-6-ylamino) stilbene-2-sulphonate, disodium 4,4'-bis-(4-phenyl-2,1,3-triazol-2-yl)-stilbene-2,2' disulphonate, disodium 4,4'-bis-(2-anilino-4-(1 methyl-2-hydroxyethylamino)-s-triazin-6-ylamino)stilbene-2,2' disulphonate, sodium 2(stilbyl-4"-(naphtho-1',2':4,5)-1,2,3-triazole-2"-sulphonate and 4,4'-bis (2-sulphostyryl)biphenyl. Brighteners have been marketed under the trade names Tinopal™ by Ciba-Geigy and are described in greater detail in European Patent Application EP-A-753-567 and U.S. Pat. No. 5,174,927. Commercial sources of optical brighteners include Ciba Specialty Chemicals and Bayer. Optical brighteners will typically be incorporated into the laundry detergent compositions herein in concentrations ranging from about 0.001% to about 1%, more typically from about 0.05% to about 0.5% by weight.

Fabric Care Benefit Agents

In another embodiment of the present invention, the composition comprises a fabric care benefit agent as a laundry adjunct. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the composition are suitably at levels of up to 30% by weight of the composition, more typically from 1% to 20%, preferably from 2% to 10% in certain embodiments. For the purposes of the present invention, silicone derivatives are any silicone materials which can deliver fabric care benefits and can be incorporated into a liquid treatment composition as an emulsion, latex, dispersion, suspension and the like. In laundry products these are most commonly incorporated with suitable surfactants. Another preferred fabric care benefit agent is a fatty acid. When deposited on fabrics, fatty acids or soaps thereof will provide fabric care (softness, shape retention) to laundry fabrics. Useful fatty acids (or soaps=alkali metal soaps such as the sodium, potassium, ammonium, and alkyl ammonium salts of fatty acids) are the higher fatty acids containing from about 8 to about 24 carbon atoms, more preferably from about 12 to about 18 carbon atoms. Fatty acids can be from natural or synthetic origin, both saturated and unsaturated with linear or branched chains.

Deposition Aid

As used herein, "deposition aid" refers to any cationic polymer or combination of cationic polymers that significantly enhance the deposition of the fabric care benefit agent onto the fabric during laundering. An effective deposition aid preferably has a strong binding capability with the water insoluble fabric care benefit agents via physical forces such as van der Waals forces or non-covalent chemical bonds such as hydrogen bonding and/or ionic bonding. It preferably has a very strong affinity to natural textile fibers, particularly cotton fibers. Preferably, the deposition aid is a cationic or amphoteric polymer. The amphoteric polymers of the present invention will also have a net cationic charge, i.e.; the total cationic charges on these polymers will exceed the total anionic charge. The cationic charge density of the polymer ranges from about 0.05 milliequivalents/g to about 6 milliequivalents/g. The charge density is calculated by dividing the number of net charge per repeating unit by the molecular weight of the repeating unit. In one embodiment, the charge density varies from 0.1 milliequivants/g to 3 milliequivalents/g. The positive charges could be on the backbone of the polymers or the side chains of polymers. Non-limiting examples of deposition aids are cationic polysaccharides, chitosan and its derivatives and cationic synthetic polymers. More particularly preferred deposition aids are selected from the group consisting of cationic hydroxy ethyl cellulose, cationic starch, cationic guar derivatives and mixtures thereof.

Builder

The compositions of the present invention may optionally comprise a builder. Suitable builders are discussed below: Suitable polycarboxylate builders include cyclic compounds, particularly alicyclic compounds, such as those described in U.S. Pat. Nos. 3,923,679; 3,835,163; 4,120,874 and 4,102,903. Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetra-acetic acid and nitrilotriacetic acid, as well as polycarboxylates such as mellitic acid, succinic acid, oxydisuccinic acid, poly-maleic acid, benzene 1,3,5-tricarboxylic acid, carboxymethyloxysuccinic acid, and soluble salts thereof. Citrate builders, e.g., citric acid and soluble salts thereof (particularly sodium salt), are polycarboxylate builders of particular importance for heavy duty liquid detergent formulations due to their availability from renewable resources and their biodegradability. Oxydisuccinates are also especially useful in such compositions and combinations.

Other Adjuncts

Examples of other suitable laundry adjunct materials include, but are not limited to, alkoxylated benzoic acids or salts thereof such as trimethoxy benzoic acid or a salt thereof (TMBA); enzyme stabilizing systems; chelants including amino-carboxylates, amino-phosphonates, nitrogen-free phosphonates, and phosphorous- and carboxylate-free chelants; inorganic builders including inorganic builders such as zeolites and water-soluble organic builders such as polyacrylates, acrylate/maleate copolymers and the like scavenging agents including fixing agents for anionic dyes, complexing agents for anionic surfactants, and mixtures thereof; effervescent systems comprising hydrogen peroxide and catalase; soil release polymers; dispersants; suds suppressors; dyes; colorants; filler salts such as sodium sulfate; hydrotropes such as toluene-sulfonates, cumene-sulfonates and naphthalene-sulfonates; photo activators; hydrolysable surfactants; preservatives; anti-oxidants; anti-shrinkage agents; anti-wrinkle agents; germicides; fungicides; color speckles; colored beads, spheres or extradites; sunscreens; fluorinated compounds; clays; luminescent agents or chemiluminescent agents; anti-corrosion and/or appliance protectant agents; alkalinity sources or other pH adjusting agents; solubilizing agents; processing aids; pigments; free radical scavengers, and mixtures thereof. Suitable materials include those described in U.S. Pat. Nos. 5,705,464, 5,710,115, 5,698,504, 5,695,679, 5,686,014 and 5,646,101. Mixtures of the above components can be made in any proportion.

Packaging Form of the Compositions

The compositions herein may be packaged in a variety of suitable detergent packaging container known to those skilled in the art. The liquid compositions are preferably packaged in transparent or translucent container, more preferably transparent container.

As used herein, the term "transparent" indicates a container which exhibits good clarity and, thus, which has the property of allowing light to pass through. Therefore, transparent container can be clearly seen through. As used herein, the term "translucent" indicates a container which only allows some light to pass through (diffusely). The compositions of the present invention may be also packaged as an encapsulated and/or unitized dose. Compositions used in unitized dose products comprising a liquid composition enveloped within a water-soluble film are often described to be non-aqueous.

Encapsulated Composition

The compositions of the present invention may be encapsulated within a water soluble film. The water-soluble film may be made from polyvinyl alcohol or other suitable variations, carboxy methyl cellulose, cellulose derivatives, starch, modified starch, sugars, PEG, waxes, or combinations thereof.

In another embodiment the water-soluble may include other adjuncts such as co-polymer of vinyl alcohol and a carboxylic acid. U.S. Pat. No. 7,022,656 B2 describes such film compositions and their advantages. One benefit of these copolymers is the improvement of the shelf-life of the pouched detergents thanks to the better compatibility with the detergents. Another advantage of such films is their better cold water (less than 10° C.) solubility. Where present the level of the co-polymer in the film material, is at least 60% by weight of the film. The polymer can have any weight average molecular weight, preferably from 1000 daltons to 1,000,000 daltons, more preferably from 10,000 daltons to 300,000 daltons, even more preferably from 15,000 daltons to 200,000 daltons, most preferably from 20,000 daltons to 150,000 daltons. Preferably, the co-polymer present in the film is from 60% to 98% hydrolysed, more preferably 80% to 95% hydrolysed, to improve the dissolution of the material. In a highly preferred execution, the co-polymer comprises from 0.1 mol % to 30 mol %, preferably from 1 mol % to 6 mol %, of said carboxylic acid.

It may be useful that the pouch or water-soluble film itself comprises a detergent additive to be delivered to the wash water, for example organic polymeric soil release agents, dispersants, dye transfer inhibitors. Optionally the surface of the film of the pouch may be dusted with fine powder to reduce the coefficient of friction. Sodium aluminosilicate, silica, talc and amylose are examples of suitable fine powders.

The encapsulated pouches of the present invention can be made using any convention known techniques. More preferably the pouches are made using horizontal form filling thermoforming techniques.

Composition Preparation

The compositions herein can generally be prepared by mixing the ingredients together and adding the colored interference pigment. If however a rheology modifier is used, it is preferred to first form a pre-mix within which the rheology modifier is dispersed in a portion of the water eventually used to comprise the compositions. This pre-mix is formed in such a way that it comprises a structured liquid.

To this structured pre-mix can then be added, while the pre-mix is under agitation, the surfactant(s) and essential laundry adjunct materials, along with water and whatever optional detergent composition adjuncts are to be used. Any convenient order of addition of these materials, or for that matter, simultaneous addition of these composition components, to the pre-mix can be carried out. The resulting combination of structured premix with the balance of the composition components forms the aqueous liquid matrix to which the colored interference pigment will be added.

In a particularly preferred embodiment wherein a crystalline, hydroyxl-containing structurant is utilized, the following steps can be used to activate the structurant:

1) A premix is formed by combining the crystalline, hydroxyl-stabilizing agent, preferably in an amount of from about 0.1% to about 5% by weight of the premix, with water which comprises at least 20% by weight of the premix, and one or more of the surfactants to be used in the composition, and optionally, any salts which are to be included in the detergent composition.
2) The pre-mix formed in Step 1) is heated to above the melting point of the crystalline, hydroxyl-containing structurant.
3) The heated pre-mix formed in Step 2) is cooled, while agitating the mixture, to ambient temperature such that a thread-like structuring system is formed within this mixture.
4) The rest of the detergent composition components are separately mixed in any order along with the balance of the water, to thereby form a separate mix.
5) The structured pre-mix from Step 3) and the separate mix from Step 4) are then combined under agitation to form the structured aqueous liquid matrix into which the visibly distinct beads will be incorporated.

The following examples will further illustrate the present invention

EXAMPLE 1

The following liquid detergent compositions are made by mixing the listed ingredients in the listed proportions (weight % unless otherwise specified).

Compositions A to H represent liquid laundry detergent compositions. Compositions I to P represent liquid hand-dish detergent compositions.

| | A | B | C | D |
|---|---|---|---|---|
| Alkylbenzene sulfonic acid | 0.79 | 0.79 | 0.79 | 0.79 |
| Sodium C12-14 alkyl ethoxy 3 sulfate | 10.6 | 10.6 | 10.6 | 10.6 |
| C14-15 alkyl 8-ethoxylate | 6.25 | 6.25 | 6.25 | 6.25 |
| C12-18 Fatty acid | 7.0 | 7.0 | 7.0 | 7.0 |
| Citric acid | 3.75 | 3.75 | 3.75 | 3.75 |
| Ethoxysulfated Hexamethylene DiamineDimethyl Quat | 1.11 | 1.11 | 1.11 | 1.11 |
| Diethylenetriaminepenta (methylenephosphonic) acid | 0.17 | 0.17 | 0.17 | 0.17 |
| FWA(4) | — | — | — | 0.03 |
| 1,2 propanediol | 3.64 | 3.64 | 3.64 | 2.64 |
| ethanol | — | — | — | 1 |
| Hydrogenated castor oil(3) | 0.2 | 0.2 | 0.2 | 0.2 |
| Boric acid | 1.25 | 1.25 | 1.25 | 1.25 |
| Terpolymer of acrylic acid, polyacryl amide and 3-trimethylammonium propyl methacrylamide chloride | — | 0.3 | 0.3 | 0.3 |
| Dye | | | | |
| Liquitint Blue 297(1) | — | 0.0091 | — | — |
| Liquitint Violet LS(1) | 0.0019 | — | — | — |
| Liquitint Blue 5GL007(1) | — | — | 0.008 | 0.008 |
| Colored interference pigment | | | | |
| Lumina Red(2) | — | — | 0.025 | 0.025 |
| Lumina Gold(2) | 0.01 | 0.025 | — | — |
| Exterior Gold(2) | — | — | — | — |
| Perfume | 1.0 | 1.0 | 1.0 | 1.0 |

-continued

| Buffers (NaOH, MEA)<br>Water and minors | to pH 8<br>to 100 parts | to pH 8<br>to 100 parts | to pH 8<br>to 100 parts | to pH 8<br>to 100 parts |
|---|---|---|---|---|
| | E | F | G | H |
| Alkylbenzene sulfonic acid | 0.79 | 0.79 | 0.79 | 24 |
| Sodium C12-14 alkyl ethoxy 3 sulfate | 10.6 | 10.6 | 10.6 | — |
| C14-15 alkyl 8-ethoxylate | 6.25 | 6.25 | 6.25 | — |
| C12-14 alkyl 7-ethoxylate | — | — | — | 19 |
| C12-18 Fatty acid | 7.0 | 7.0 | 7.0 | 15 |
| Citric acid | 3.75 | 3.75 | 3.75 | 0.5 |
| Ethoxysulphate Hexamethylene DiamineDimethyl Quat. | 1.1 | 1.1 | 1.1 | 2.5 |
| Diethylenetriaminepenta (methylenephosphonic) acid | 0.17 | 0.17 | 0.17 | — |
| Hydroxy-ethane diphosphonic acid | — | — | — | 1.0 |
| FWA(4) | — | — | — | 0.2 |
| 1,2 propanediol | 2.64 | — | 3.64 | 15 |
| ethanol | 1 | — | — | — |
| Monoethanolamine | — | — | — | 9.5 |
| Hydrogenated castor oil(3) | 0.2 | 0.2 | — | — |
| Polyacrylate thickener(5) | - | — | 1 | — |
| Boric acid | 1.25 | 1.25 | 1.25 | — |
| Terpolymer of acrylic acid, polyacryl amide and 3-trimethylammonium propyl methacrylamide chloride | 0.3 | 0.3 | — | — |
| Dye | | | | |
| Liquitint Blue 297(1) | 0.008 | — | — | 0.008 |
| Liquitint Violet LS(1) | — | 0.00028 | 0.00028 | — |
| Liquitint Blue 5GL007(1) | — | — | — | — |
| Liquitint Yellow FT(1) | — | 0.001 | 0.001 | — |
| Liquitint Pink AM(1) | — | 0.018 | 0.018 | — |
| Coloured interference pigment | | | | |
| Lumina Red(2) | — | — | — | — |
| Lumina Gold(2) | — | — | — | — |
| Exterior Gold(2) | 0.020 | — | — | 0.020 |
| Lumina Aquablue(2) | — | 0.05 | 0.05 | — |
| Enzymes | 0-3 | 0-3 | 0-3 | 0-3 |
| Perfume | 1.0 | 1.0 | 1.0 | 1.5 |
| Buffers & neutralizers (NaOH) | To pH 8 | To pH 8 | To pH 8 | — |
| Water and minors | To 100 parts | To 100 parts | To 100 parts | To 100 parts |

| | I | J | K | L | M | N | O | P |
|---|---|---|---|---|---|---|---|---|
| AES EO 0.5-1(6) | 17 | 17 | 17 | 17 | 27 | 27 | 27 | 27 |
| Amine Oxide | 6 | 6 | 6 | 6 | 5 | 5 | 5 | 5 |
| Polycarboxylate Polymer | 0.3 | 0.3 | 0 | 0 | 0.3 | 0.3 | 0 | 0 |
| Polypropylene Glycol | 0.5 | 0.5 | 0.5 | 0.5 | 0.5 | 0.5 | 0.5 | 0.5 |
| Ethanol | 1.5 | 1.5 | 1.5 | 1.5 | 1.5 | 1.5 | 1.5 | 1.5 |
| NaCl | 0.5 | 0.5 | 0.5 | 0.5 | 0.5 | 0.5 | 0.5 | 0.5 |
| BCM structurant(7) | 0 | 0.05 | 0 | 0.05 | 0 | 0.05 | 0 | 0.05 |
| HCO structurant(8) | 0.1 | 0 | 0.1 | 0 | 0.1 | 0 | 0.1 | 0 |
| Dye | | | | | | | | |
| Liquitint Blue 297 | — | — | 0.0006 | 0.0006 | — | — | 0.006 | 0.006 |
| Liquitint Blue 5GL007 | 0.00005 | 0.00005 | — | — | 0.0005 | 0.0005 | — | — |
| Interference pigment | | | | | | | | |
| Lumina Red | — | — | 0.025 | 0.025 | — | — | 0.025 | 0.025 |
| Lumina Gold | 0.025 | 0.025 | — | — | 0.025 | 0.025 | — | — |
| Water and minors | balance | balance | balance | balance | balance | balance | balance | balance |
| pH at 10% dilution | 9 | 9 | 9 | 9 | 9 | 9 | 9 | 9 |

(1)available from Milliken.
(2)available from BASF.
(3)Hydrogenated castor oil is Thixcin ® available from Elementis.
(4)FWA is Fluorescent Whitening Agent, Tinopal CBS from Ciba.
(5)Polyacrylate thickener is Carbopol Aqua 30 from Noveon.
(6)Alkyl ethoxylated sulphate sodium salt EO 0.5-1.
(7)Bacterial Cellulose Mix comprising bacterial Cellulose, Carboxymethylcellulose and xanthan gum.
(8)Hydrogenated castor oil structurant

EXAMPLE 2

The following table illustrates the Wavelength at an absorption band of the composition with a dye system and of the colored interference pigment in solution (in water) obtained for the compositions A-C of Example 1. The table illustrates also the perception of color obtained (Bias is to be understood by reference to the FIGURE in the example 4).

| | A | B | C |
|---|---|---|---|
| Wavelength at maximum absorption of the composition with a dye system (nm) | 598 | 598 | 657 |
| Wavelength at minimum absorption of colored interference pigment dispersed in water (nm) | 416 | 416 | 478 |
| Color liquid detergent composition/ Colored interference pigment | Blue (violet bias)/ Yellow (green bias) | Blue (violet bias)/ Yellow (green bias) | Green (blue bias)/ Orange (red bias) |

EXAMPLE 3

Method for the Color Determination of Liquid Detergent Composition Comprising a Dye System The Color determination of liquid detergent composition, comprising a dye system, is determined by the measure of the absorption of the liquid detergent composition.

The Color determination of colored interference pigments is determined by the measure of the absorption of the pigment dispersed in water (0.02%-0.3%)

Measurements are made with the UVIKON UV-Vis spectrometer. The absorption is then plotted versus the wavelength.

Principle of UVIKON UV-Vis Spectrometer:

A collimated light beam is led on a reflecting diffraction grating mounted on a stepped motor drive. The light beam reflected from the grating has a specific wavelength and is led via minors through a transparent cell containing the liquid sample. The beam passing through the cell is then led to a photodiode where the light intensity is translated in an electrical signal proportional to the intensity of the light beam. The difference between the incident light beam hitting the sample (I0) the transmitted light (I) is the absorbed light (I0−I) and is proportional to the concentration of a given chemical compound present in the sample. By moving the diffraction grating other wavelengths can be chosen.

Measurements can either be done at a fixed wavelength (=grating position) or scanned through a wavelength range. The fixed position measurements are used to determine the presence and/or concentration of a species in the sample. The scan is used to obtain sample spectra used for fingerprinting, detection of chemical bonds, chromophores.

Units:

Transmission T: the fraction of light passing through the sample (in %).

Absorption A: the fraction of light being absorbed by the sample (1−T).

Extinction or absorbance, E: the negative logarithm of transmission (−log T)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid laundry or hard surface treatment composition exhibiting an at least two color effect, said composition comprising:

a) a cleaning system, wherein said cleaning system comprises a detersive enzyme;

b) an aesthetic system comprising:

i. from 0.0001% to 0.5% by weight of the composition of a colored interference pigment having a color and showing an absorbance minimum in the range from about 380 to about 750 nm range of the light spectrum, and ii. from 0.0005% to 0.1% by weight of the composition of a soluble dye system, wherein the color of the colored interference pigment is selected so as to be complementary to a color reflected by the composition comprising the dye in absence of the colored interference pigment, wherein the weight percentage of the interference pigment exceeds the weight percentage of the dye system, and wherein the composition does not contain pearlescent pigments which reemit silvery-white light without specific color.

2. The composition according to claim 1, wherein the dye system shows an absorption maximum in the range of from about 620 to about 750 nm and wherein the colored interference pigment shows an absorption minimum in the range of from about 570 to about 590 nm.

3. The composition according to claim 1, wherein the dye system shows an absorption maximum in the range of from about 380 to about 495 nm and wherein the colored interference pigment shows an absorption minimum in the range of from about 570 to about 590 nm.

4. The composition according to claim 1, wherein the dye system shows an absorption maximum in the range of from about 380 to about 570 nm and wherein the colored interference pigment shows an absorption minimum in the range of from about 590 to 620 nm.

5. The composition according to claim 1, wherein the dye system shows an absorption maximum in the range from about 450 to about 590 nm and wherein the colored interference pigment shows an absorption minimum in the range from about 620 to about 750 nm.

6. The composition according to claim 1, wherein the dye system shows an absorption maximum in the range of from about 495 to about 620 nm and wherein the colored interference pigment shows an absorption minimum in the range of from about 380 to about 450 nm.

7. The composition according to claim 1, wherein the dye system shows an absorption maximum in the range of from about 570 to about 750 nm and wherein the colored interference pigment shows an absorption minimum in the range of from about 450 to about 495 nm.

8. The composition according to claim 1, wherein the dye system shows an absorption maximum in the range of from about 590 to about 750 nm and wherein the colored interference pigment shows an absorption minimum in the range from of about 495 to about 570 nm.

9. The composition according to claim 1, wherein the dye system shows an absorption maximum in the range of from about 380 to about 450 nm and wherein the colored interference pigment shows an absorption minimum in the range from of about 495 to about 570 nm.

10. The composition according to claim 1, wherein the cleaning system comprises at least one surfactant.

11. The composition according to claim 10, wherein the cleaning system comprises at least one surfactant in an amount of at least about 5% by weight of the total composition.

12. The composition according to claim 1, wherein the colored interference pigment comprises a substrate and a layer coating the substrate, wherein said layer has a thickness greater than about 60 nm.

13. The composition according to claim 1, wherein the composition comprises at least one laundry adjunct selected from theology modifiers and fluorescent whitening agents.

14. The composition according to claim 1, wherein the composition is packaged in transparent container.

15. The composition according to claim 1, wherein the composition is packaged in a translucent container.

16. The composition according to claim 12, wherein the substrate comprises mica.

17. The composition according to claim 12, wherein the layer coating the substrate comprises titanium dioxide.

18. The composition according to claim 1, wherein the colored interference pigment is mica coated with a titanium dioxide (TiO2) layer, wherein the TiO2 layer is selected from the group consisting of: a $TiO_2$ layer having a thickness comprised between 60 and 80 nm in view of exhibiting a gold color; a $TiO_2$ layer having a thickness comprised between 80 and 100 nm in view of exhibiting a red color; a $TiO_2$ layer having a thickness comprised between 100 and 140 nm in view of exhibiting a blue color; and a $TiO_2$ layer having a thickness comprised between 120 and 160 nm in view of exhibiting a green color.

* * * * *